US008591824B2

(12) United States Patent
Hsiao et al.

(10) Patent No.: US 8,591,824 B2
(45) Date of Patent: Nov. 26, 2013

(54) HEAT TREATING FURNACE

(75) Inventors: Ying-Shih Hsiao, Taipei (TW); Toshiaki Yoshimura, Iruma (JP)

(73) Assignees: Kern Energy Enterprise Co., Ltd., Taipei (TW); Toshiaki Yoshimura, Saitama (JP)

( * ) Notice: Subject to any disclaimer, the term of this patent is extended or adjusted under 35 U.S.C. 154(b) by 211 days.

(21) Appl. No.: 13/338,378

(22) Filed: Dec. 28, 2011

(65) Prior Publication Data

US 2013/0084216 A1 Apr. 4, 2013

(30) Foreign Application Priority Data

Oct. 4, 2011 (TW) ..... 100135880 A

(51) Int. Cl.

| | |
|---|---|
| ***B01J 19/00*** | (2006.01) |
| *B01J 8/00* | (2006.01) |
| *G05B 1/00* | (2006.01) |
| *F23M 7/00* | (2006.01) |
| *B05C 11/00* | (2006.01) |
| *C23C 16/00* | (2006.01) |

(52) U.S. Cl.

USPC ..... 422/198; 422/105; 422/129; 422/187; 110/173B; 118/663; 118/688; 118/694; 118/696; 118/697; 118/715; 118/722; 118/724; 118/725; 118/728

(58) Field of Classification Search

USPC ..... 422/105, 107, 129, 187, 198; 110/173 B; 118/663, 688, 694, 696, 118/697, 715, 722, 724, 725, 728

See application file for complete search history.

(56) References Cited

U.S. PATENT DOCUMENTS

| | | | | |
|---|---|---|---|---|
| 4,957,711 | A * | 9/1990 | Min et al. | 117/223 |
| 5,498,292 | A * | 3/1996 | Ozaki | 118/724 |
| 7,321,722 | B2 * | 1/2008 | Tsai | 392/416 |
| 7,704,898 | B2 * | 4/2010 | Nenyei et al. | 438/795 |
| 7,935,188 | B2 * | 5/2011 | Nakajima et al. | 118/724 |

* cited by examiner

*Primary Examiner* — Walter D Griffin
*Assistant Examiner* — Natasha Young
(74) *Attorney, Agent, or Firm* — Ming Chow; Sinorica, LLC

(57) ABSTRACT

The heat treating furnace for the gas reaction includes an outer body, an inner body, a heating mechanism, gas supplying mechanism, and a controller. Using the controller to control the amount of gas supply effectively keeps the first pressure ($P_1$) in the gas circulation chamber outside the inner body greater than the second pressure ($P_2$) in the reaction chamber inside the inner body all the time. In this way, the flow rate of gas inlet, reaction rate, cooling rate can be facilitated, and the uniformity of the thin film and the operational safety can be improved.

30 Claims, 10 Drawing Sheets

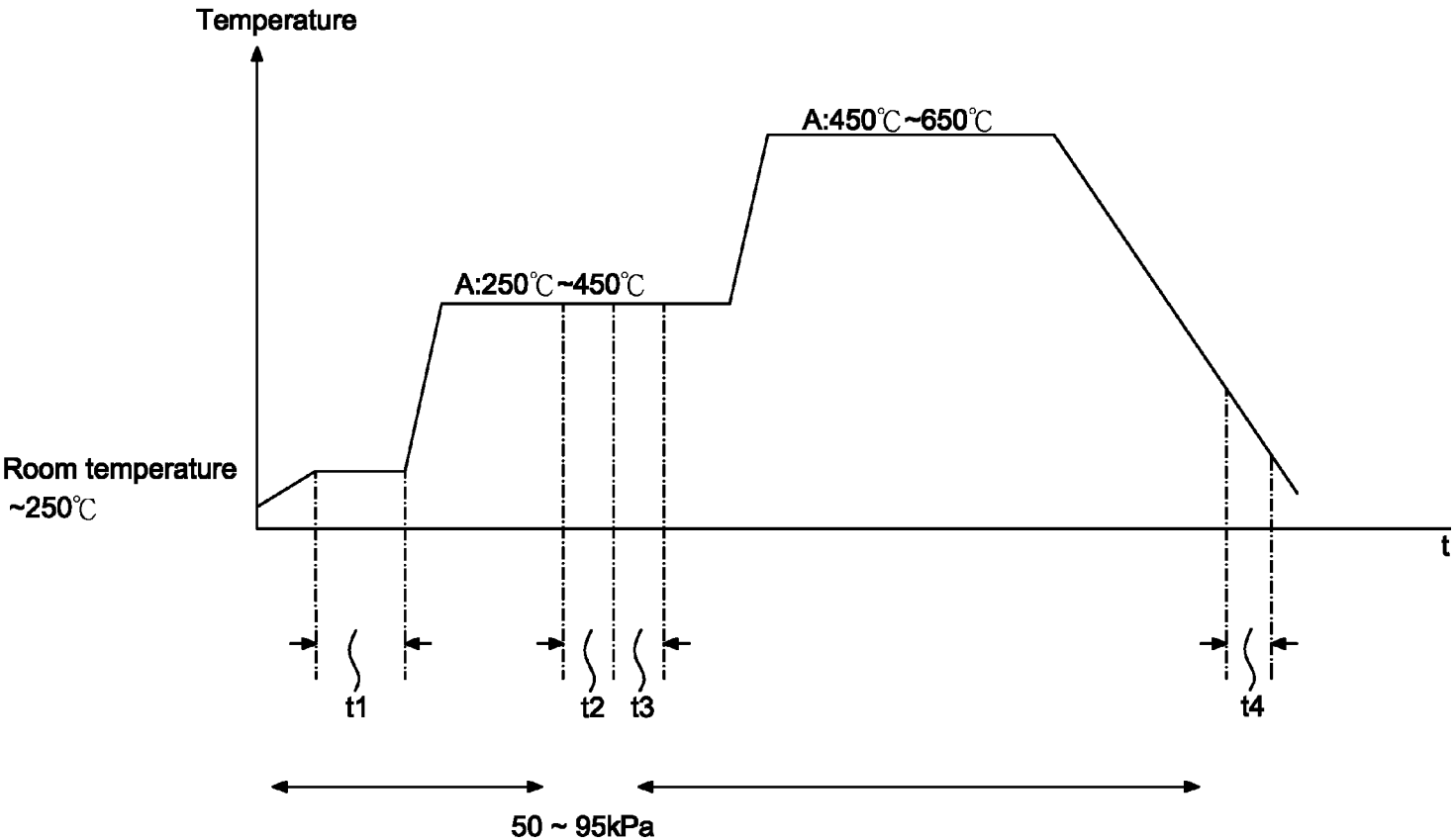
Fig.1b（Prior Art）

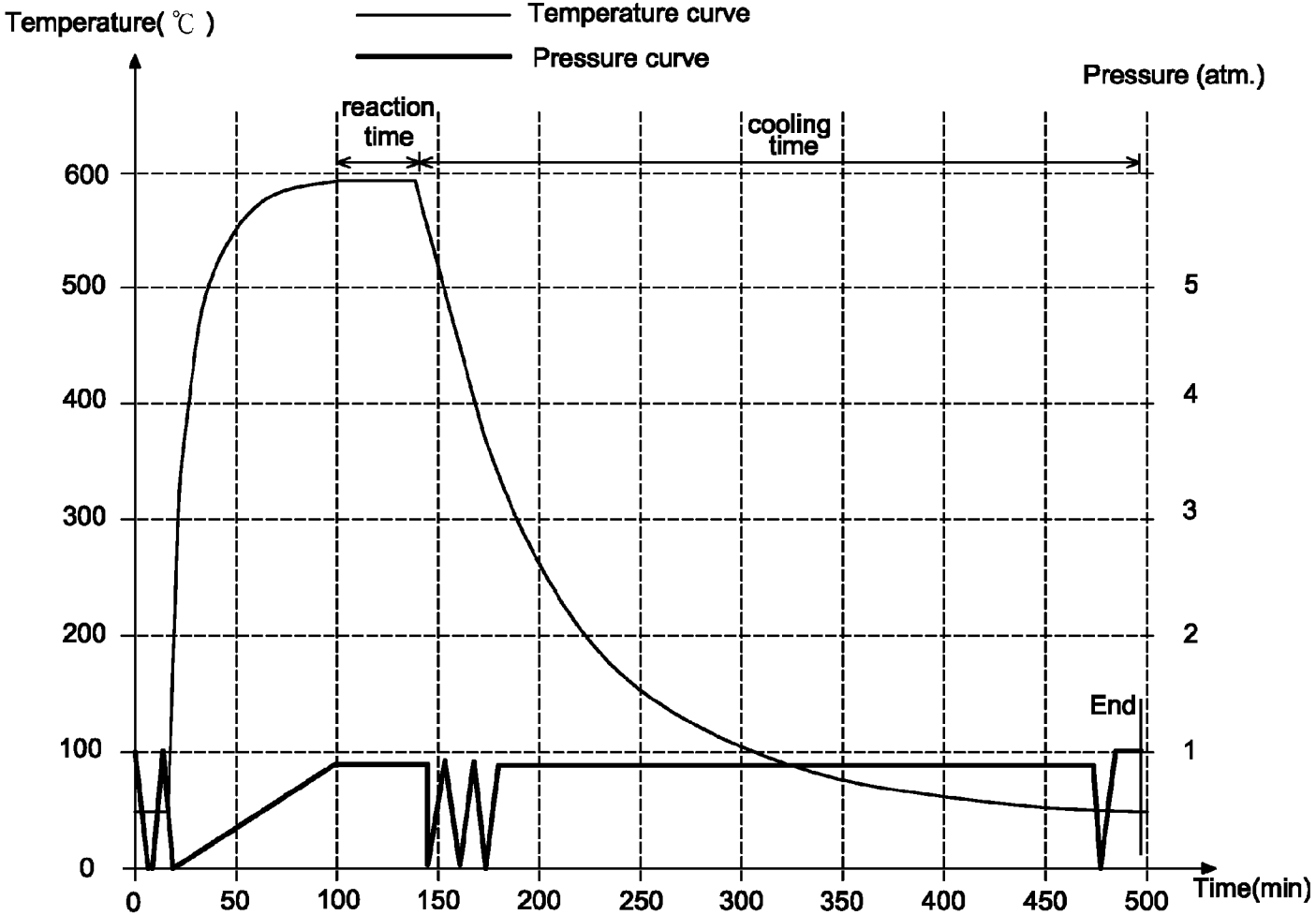
Fig.1c（Prior Art）

HEAT TREATING FURNACE

BACKGROUND OF THE INVENTION

1. Field of the Invention

This invention relates to a heat treating furnace, and more particularly to a heat treating furnace capable of performing heat treatments under high pressure. The heat treating furnace provides a double-chamber structure including a gas circulation chamber and a reaction chamber. By controlling the relative gas density and pressure of the chambers, the reaction gases can be mixed uniformly and the reaction could be facilitated under high pressure. Hence the quality of the formed thin film and the operational safety are improved.

2. Description of the Prior Art

With the development of compound thin film solar cell technologies, the thin film fabrication have been used in generating more and more products, thus the demand of equipments for developing the thin film or the thin film precursor on substrates is greatly increased. However, the present methods of developing the thin film include spattering and co-evaporation. Especially for fabricating the products which are mass produced successfully in thin-film photovoltaic industry, spattering is the most commonly used technique in developing the thin film precursor prior to the chemical reaction process to form the thin film.

Furthermore, among the techniques of performing chemical reaction processes on the thin film precursor for forming thin films, providing chemical compound vapor is the most suitable method for mass production. It is an advantageous way of providing chemical compound vapor to supply the required elements for forming the thin film precursor, such that the concentration and the diffusion of ingredients for forming the thin film precursor can be accurately controlled. As a result, the development of techniques and equipments of performing chemical reactions for forming thin films which employ the heat treating furnace grows vigorously. Taking the selenization process of Copper Indium Gallium Diselenide (CIGS) solar cell as an example, the spattering deposition technique is used for forming multiple-layer precursors containing alloys or monomers of copper (Cu), gallium (Ga) and indium (In) on a soda lime glass substrate to constitute the structure of CIGS solar cell. Then the layered structure for producing CIGS solar cell is transferred into a selenization furnace (i.e. heat treating furnace), and the gaseous hydrogen selenide ($H_2Se$) is introduced into the selenization furnace and is heated to the temperature of 400° C. or a higher temperature to start the reaction between the gaseous hydrogen selenide and the multiple-layer precursors. However, the selenization process of CIGS solar cell fabrication, heating the solar cell structure with multiple-layer thin films is required for reacting with gaseous hydrogen selenide to produce the high-quality CIGS films. For example, a copper-gallium (Cu—Ga) alloy layer, a copper-indium (Cu—In) alloy layer and an indium layer are deposited to form the three-layer precursor (CuGa/CuIn/In) film of uniform thickness. The three-layer precursor film is transferred into a selenization furnace immediately after the deposition. Then the gaseous hydrogen selenide is introduced and the three-layer precursor film is heated to the temperature of 400° C. at the heating rate of 40° C./min, and the three-layer precursor film is reacted with selenide to form a compound CIGS layer. The compound CIGS layer is then heated to 550° C. at the heating rate of 15° C./min to provide the optimal crystal structure, followed by a step of cooling, and the compound CIGS layer is formed.

Due to that the selenization process is performed at the temperature range of 520 to 590° C., a large thick quartz tubes is utilized to be the inner body in the conventional heat treating furnace, and the outer side is tightly contacted to the thermal insulating materials, as a result, inside the heat treating furnace is in a closed status. In addition, the effects of thermal expansion and contraction makes the reaction gas with higher temperature flowing upward and the reaction gas with lower temperature flowing downward, which result in poor gas mixing in the selenization process, thus further result in variant quality and the thickness of the compound CIGS layer on the glass substrate. Furthermore, the reaction gases such as hydrogen selenide used in the selenization process are toxic; therefore the pressure inside the selenization furnace needs to be controlled at low pressure (i.e. lower than 1 atm) throughout the whole selenization process for the safety considerations and avoids the leakage of reaction gases otherwise causes industrial safety concerns. In this situation, the selenization process under low pressure evokes insufficient total gas molecules and results in the deterioration of the temperature gradient inside the selenization furnace, and also deteriorates the gas mixing uniformity. Those events result in a vicious circle that slow down the reaction rate and simultaneously worsen the uniformity of thin film. Apparently, the low pressure and the non-uniform temperature of present selenization furnaces generally result in the problems of selenium gas heterogeneity and ineffective thin film formation, thus the ultimate difficulty of promoting the photovoltaic conversion efficiency.

FIG. 1*a* and 1*b* show schematically a prior art the embodiment of U.S. Pat. No. 7,871,502 patent. Referring to FIG. 1*a*, the selenization furnace includes only one closed reaction chamber provided for the selenization process of compound CIGS, and the pressure inside the chamber is kept lower than 1 atm throughout the whole selenization process. FIG. 1*b* shows the temperature profile diagram of selenization process. FIG. 1*c* shows the temperature and the pressure profile of the selenization process inside the selenization furnace shown in FIG. 1*a*. After closing the selenization furnaces, repeatedly pumping out the air inside the selenization furnace and pumping gaseous nitrogen into the reaction chamber is required to ensure that the reaction chamber is full of gaseous nitrogen. The operational pressure of reaction chamber of the conventional selenization furnace is kept at low pressure (i.e. lower than 1 atm) concerning the safety. The pressure in the reaction camber is controlled within a range of 0.8 to 0.9 atm throughout the whole reaction process. The gaseous pressure inside the reaction chamber increases as the selenization furnace is heated to the temperature of 590° C., thus, the gas is eliminated repeatedly for the purpose of reducing the pressure to maintain the pressure inside the reaction chamber at a set point. However, during the process of gas elimination, energy and excessive gas are wasted. When the temperature reaches the set point for reaction, the reaction gases are introduced simultaneously into the reaction chamber. Generally, hydrogen selenide (10%) and gaseous nitrogen (90%) which is the carrier gas are used for reaction. As shown in FIG. 1*c*, the reaction time of selenization is less than 100 minutes, but apparently the gas flows in the reaction chamber cannot be convected and the temperature cannot be uniformed in such short reaction time. Therefore, the uniformity of selenization is deteriorated which causes the variant thickness and quality of the compound CIGS layer on the substrates.

Following the reaction of forming the compound CIGS layer, the selenization furnace needs to be cooled down to transfer the CIGS solar cell substrate out of the selenization furnace. However, the reaction chamber of the inner body is a closed space, the only way to cool down the selenization furnace is pumping the gaseous nitrogen into inner body of the furnace and pumping out the gas at the same time which is a time consuming cooling process. As shown in FIG. 1*c*, this cooling process generally takes 5 to 8 hours, but when it comes to a larger substrate, it takes even more than 10 hours. Thus, tremendous manpower and resources are required, resulting in retarding the fabrication. Additionally, as shown in FIG. 1*a*, the gas pipes and the signal transmission circuit of the selenization furnace are located on the gate doors. However the gate doors need to be frequently opened in the fabrication, which may result in loosening or fracturing the gas pipes and the signal transmission circuit, making the operation being hazardous. In view of this, attempts have been made in the present invention to solve the aforementioned problems and drawbacks by providing a newly improved heat treating furnace.

SUMMARY OF THE INVENTION

To solve the above mentioned drawbacks, an objective of this invention is to design a heat treating furnace provided with a gas circulation chamber between an inner body and outer body to maintain a pressure difference therein. Thus the density of gas molecules or the gaseous pressure inside the inner body can be increased to facilitate the chemical reaction rate of the thin film and improve the uniformity of the thin film.

Another objective of this invention is to provide a gas circulation chamber in the heat treating furnace for simultaneously introducing the cooling gaseous nitrogen into a reaction chamber inside the inner body and the gas circulation chamber between the inner body and the outer body, and therefore facilitating the flow rate of gaseous nitrogen and effectively accelerating cooling rate.

A further objective of this invention is to provide a gas circulation chamber in the heat treating furnace for simultaneously introducing the cooling gaseous nitrogen into a reaction chamber inside the inner body and the gas circulation chamber between the inner body and the outer body, and therefore preventing the formation of temperature gradient in the wall of inner body, and effectively protecting the wall of inner body from chapping or peeling.

A further objective of this invention is to provide a gas circulation chamber in the heat treating furnace for filling the gaseous nitrogen to keep a first pressure (P1) in the gas circulation chamber greater than a second pressure (P2) in the reaction chamber of the inner body. A safety gate door is provided to effectively protect the operator from the danger of pressure imbalance inside the heat treating furnace.

A further objective of this invention is to provide a gas circulation chamber in the heat treating furnace which improves the operational safety, for raising the operational pressure without the limitation of low pressure (i.e. <1 atm) so that the operation can be performed at a higher pressure (i.e. >1 atm). In this way, the reaction rate and uniformity are improved and the waste of reaction gas is further reduced.

A further objective of this invention is to provide a heat treating furnace provided with a sensor for real-time monitoring the pressure in the reaction chamber inside and the gas circulation chamber of the inner body during the process of forming the thin film. It enables the effective control of the gas inflow to improve the safety and efficiency of the thin film formation.

A further objective of this invention is to provide a heat treating furnace provided with openings in the lateral sides which enable assembly of multi-stage heat treating furnaces for saving the cost of facility and transportation. Therefore it raises the production profit and reliability of the equipment.

A further objective of this invention is to provide a heat treating furnace which a controlling method is chosen from monitoring the pressure or gas density in the reaction chamber by a pressure gauge or a gas density analyzer, and the signal is transmitted to a controlling device for the following regulation so as to increase the production profit and reduce the waste of excessive gas.

According to the aforementioned objectives, the present invention provides a heat treating furnace for a gas reaction including an outer body having a first side and a second side corresponding to the first side, the first side being provided with a first gate door capable of being opened, the second side being provided with a second gate door capable of being opened. The heat treating furnace for a gas reaction further includes an inner body having an outer wall and an inner wall, being spaced and fixed inside the outer body, thereby forming a gas circulation chamber between the outer wall and the outer body and a reaction chamber between the inner wall. It enables either of the gas circulation chamber and the reaction chamber being an independent gas-tight chamber when the first gate door is being closed. The heat treating furnace for a gas reaction further includes a heating mechanism being fixed and contacted with the outer wall of the inner body. The heat treating furnace for a gas reaction further includes a gas supplying mechanism set outside the outer body being connected with one of the side of outer body and one of the side of inner body by utilizing a plurality of gas pipes such as to control the supply of a first gas into the gas circulation chamber and the supply of a second gas into the reaction chamber. The heat treating furnace for a gas reaction further includes a controller provided outside the outer body for controlling the supply amount of the first gas into the gas circulation chamber and the supply amount the second gas into the reaction chamber through the gas supplying mechanism, thereby forming a first pressure ($P_1$) in the gas circulation chamber and a second pressure ($P_2$) in the reaction chamber, wherein the controller keeps the first pressure ($P_1$) in the gas circulation chamber being greater than the second pressure ($P_2$) in the reaction chamber all the time when the heat treating furnace is operated to perform a gas reaction.

According to the aforementioned objectives, the present invention provides a heat treating furnace for a gas reaction including an outer body having a first side and a second side corresponding to the first side, the first side being provided with a first gate door capable of being opened, the second side being provided with a second gate door capable of being opened. A first gas-tight structure is arranged inside the first gate door, and a second gas-tight structure arranged inside the second gate door. The heat treating furnace for a gas reaction further includes an inner body having an outer wall and an inner wall, being spaced and fixed inside the outer body, thereby forming a gas circulation chamber between the outer wall and the outer body and a reaction chamber between the inner wall. The inner body further has a third side and a fourth side corresponding to the third side, and when the first gate door is being closed, the first gas-tight structure being hermetically sealed with the third side and the second gas-tight structure being hermetically sealed with the fourth side, thereby either of the gas circulation chamber and the reaction chamber being an independent gas-tight chamber. The heat treating furnace for a gas reaction further includes a heating mechanism being fixed next to the outer wall of the inner body. The heat treating furnace for a gas reaction further includes a gas supplying mechanism set outside the outer body being connected with one of the side of outer body and one of the side of inner body by utilizing a plurality of gas pipes such as to control the supply of a first gas into the gas circulation chamber and the supply of a second gas into the reaction chamber. The heat treating furnace for a gas reaction further includes a controller provided outside the outer body for controlling the supply amount of the first gas into the gas circulation chamber and the supply amount the second gas into the reaction chamber through the gas supplying mechanism, thereby forming a first pressure ($P_1$) in the gas circulation chamber and a second pressure ($P_2$) in the reaction chamber.

According to the aforementioned objectives, the present invention further provides a heat treating furnace for a gas reaction including an outer body having a first side and a second side corresponding to the first side, an upper side face and a lower side face for connecting the first side and the second side, thereby forming a receiving space, the first side being provided with a gate door capable of being opened, the second side being a sealed side, a first gas-tight structure arranged inside the the gate door. The heat treating furnace for a gas reaction further includes an inner body spaced and fixed inside the outer body having an outer wall, an inner wall, a third side and a fourth side, and the fourth side being connected with the sealed side thereby forming a gas circulation chamber between the outer wall and the outer body and a reaction chamber between the inner wall, and when the first gate door is being closed, the first gas-tight structure being hermetically sealed with the third side, thereby either of the gas circulation chamber and the reaction chamber being an independent gas-tight chamber. The heat treating furnace for a gas reaction further includes a heating mechanism being fixed and contacted with the outer wall of the inner body. The heat treating furnace for a gas reaction further includes a gas supplying mechanism set outside the outer body being connected with one of the side of outer body and one of the side of inner body by utilizing a plurality of gas pipes such as to control the supply of a first gas into the gas circulation chamber and the supply of a second gas into the reaction chamber. The heat treating furnace for a gas reaction further includes a controller provided outside the outer body for controlling the supply amount of the first gas into the gas circulation chamber and the supply amount the second gas into the reaction chamber through the gas supplying mechanism, thereby forming a first pressure ($P_1$) in the gas circulation chamber and a second pressure ($P_2$) in the reaction chamber.

According to the aforementioned objectives, the present invention further provides a multi-stage heat treating furnace for a gas reaction constituted by a plurality of heat treating furnaces wherein each of the heat treating furnace including an outer body having a first side and a second side corresponding to the first side, the first side being provided with a first gate door capable of being opened, the second side being provided with a second gate door capable of being opened, a first gas-tight structure arranged inside the first gate door, a second gas-tight structure arranged inside the second gate door. The multi-stage heat treating furnace for a gas reaction further includes an inner body having an outer wall and an inner wall, being spaced and fixed inside the outer body, thereby forming a gas circulation chamber between the outer wall and the outer body and a reaction chamber between the inner wall, the inner body having a third side and a fourth side corresponding to the third side, and when the first gate door is being closed, the first gas-tight structure being hermetically sealed with the third side and the second gas-tight structure being hermetically sealed with the fourth side, The multi-stage heat treating furnace for a gas reaction further includes a heating mechanism being fixed and contacted with the outer wall of the inner body. The multi-stage heat treating furnace for a gas reaction further includes a gas supplying mechanism set outside the outer body being connected with one of the side of outer body and one of the side of inner body by utilizing a plurality of gas pipes such as to control the supply of a first gas into the gas circulation chamber and the supply of a second gas into the reaction chamber. The multi-stage heat treating furnace for a gas reaction further includes a controller provided outside the outer body for controlling the supply amount of the first gas into the gas circulation chamber and the supply amount the second gas into the reaction chamber through the gas supplying mechanism, thereby forming a first pressure ($P_1$) in the gas circulation chamber and a second pressure ($P_2$) in the reaction chamber.

The present invention provides the heat treating furnace with the design of gas circulation chamber, enabling effective protection of operators, saving manpower and resources, and providing the reaction environment for high-pressure gases, those which are advantageous for forming various thin films.

BRIEF DESCRIPTION OF THE DRAWINGS

FIG. 1*b* is a schematic diagram illustrating the prior art;

FIG. 1*c* is a schematic diagram of the temperature and pressure profile in the prior art;

DESCRIPTION OF THE PREFERRED EMBODIMENT

The present invention discloses the structure and function of a heat treating furnace. For the convenience of description, an example of a heat treating furnace producing CIGS solar cells is described for illustration, wherein the structure and function of a heat treating furnace producing CIGS solar cells are well known by persons skilled in the art and thus is not described in detail hereunder. The drawings below, with which the description presented hereunder is illustrated, are intended to depict schematically the structures related to the features of the present invention and are not, and need not being, drawn to scale.

Figure 1A:
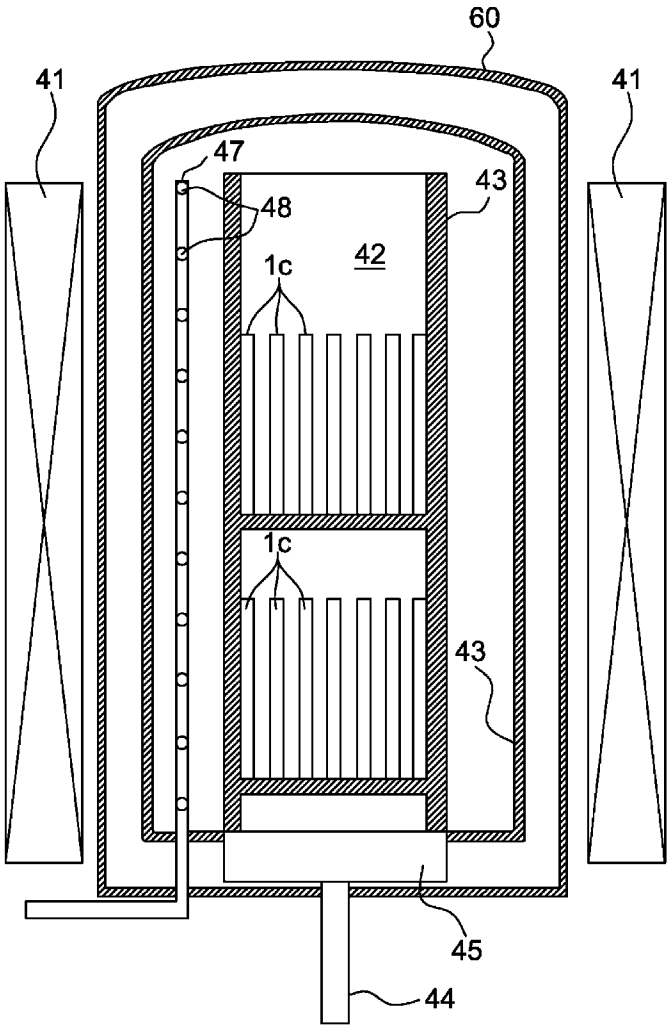
Fig.1a (Prior Art)
FIG. 1*a* is a schematic diagram illustrating the prior art.
Figure 2:
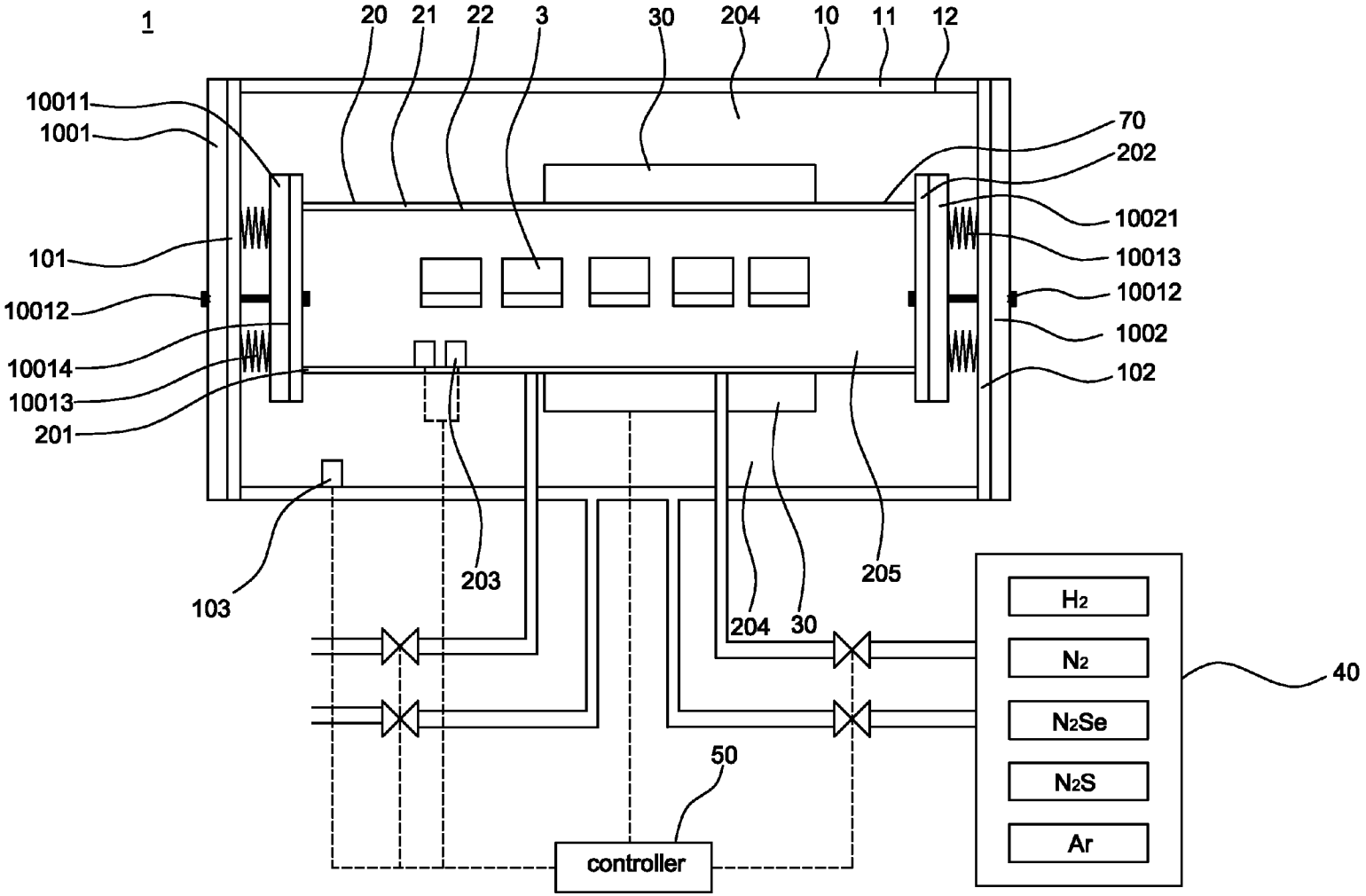
FIG. 2 is a schematic diagram representing an embodiment of the heat treating furnace in the present invention.

First, referring to FIG. 2 schematically represents an embodiment of a heat treating furnace in the present invention. As shown in FIG. 2, the heat treating furnace has a first side 101 and a second side 102 corresponding to the first side 101, the first side 101 being provided with a first gate door 1001 capable of being opened, the second side 102 being provided with a second gate door 1002 capable of being opened. A first gas-tight structure 10011 is arranged inside the first gate door 1001, and a second gas-tight structure 10012 is optionally arranged inside the second gate door 1002. In this embodiment of the present invention, the first gas-tight structure 10011 and the second gas-tight structure 10012 include a fastener 10012, a damper 10013 and a gas seal 10014. The gas seal 10014 can be made of rubber. The heat treating furnace has an inner body 20 having a third side 201, a fourth side 202 corresponding to the third side 201, an outer wall 21 and an inner wall 22, being spaced and fixed inside the outer body 10, thereby forming a gas circulation chamber 204 between the outer wall 21 of the inner body 20 and the inner wall 12 of the outer body 10 and a reaction chamber 205 inside the inner wall 22 of the inner body 20. The heat treating furnace for a gas reaction further includes a heating mechanism 30 being fixed and contacted with the outer 21 wall of the inner body 20. The heat treating furnace for a gas reaction further includes a gas supplying mechanism 40 set outside the outer body 10 being connected with one of the side of outer body 10 and one of the side of inner body 20 by utilizing a plurality of gas pipes such as to control the supply of gases into the gas circulation chamber 204 and the reaction chamber 205. The heat treating furnace for a gas reaction further includes a controller 50, which is provided outside the outer body 10 for controlling the supply amount of gases into the gas circulation chamber 204 and the reaction chamber 205 through the gas supplying mechanism 40, thereby forming a first pressure ($P_1$) in the gas circulation chamber 204 and a second pressure ($P_2$) in the reaction chamber 205, or thereby forming the feature that a first density in the gas circulation chamber 204 and a second density in the reaction chamber 205.

When the first gate door 1001 and the second gate door 1002 are closed, the first side 101 and the second side 102 of the heat treating furnace are sealed by the first gas-tight structure 10011 and the second gas-tight structure 10021. Meanwhile, the first gas-tight structure 10011 is hermetically sealed with the third side 201 by the gas seal 10014; the second gas-tight structure 10021 is also hermetically sealed with the fourth side 202 of the inner body 20 via the gas seal 10014, thereby either of the gas circulation chamber 204 between the inner wall 12 of the outer body 10 and the reaction chamber 205 between the inner wall 22 of the inner body 20 is an independent gas-tight chamber without any communication.

During the process of forming a compound CIGS layer in the heat treating furnace, introducing the gaseous hydrogen selenide into the reaction chamber 205 of the inner body 20 is required, and a high-temperature and high-pressure processing environment is also necessary for forming the compound CIGS layer with uniformity. Additionally, the gaseous hydrogen selenide introduced into the reaction chamber 205 reacts with air and generated selenium dioxide ($SeO_2$) dust which contaminate the compound CIGS layer and the inner wall 22 of the inner body 20, those which are hazardous to operators. Therefore, during the process of reaction, the gas circulation chamber 204 between the outer body 10 and the inner body 20 and the reaction chamber 205 between the inner wall 22 of the inner body 20 are required to be independent and gas-tight sealed. Based on the requirement, the outer body 10 is made of steel or stainless steel such as SUS304 and SUS316 which enables the outer body 10 is resistant to a pressure of 20 atm. However, the material used to make the outer body 10 is not limited in the present invention. Moreover, the thermal insulating material can be further provided on the inner wall 12 of the outer body 10 to disrupt the transmission of heat to the outer wall 11 of the outer body 10 during the heating process. And the thermal insulating material can be any heat-resistant material such as quartz bricks or mica brick.

Figure 3:
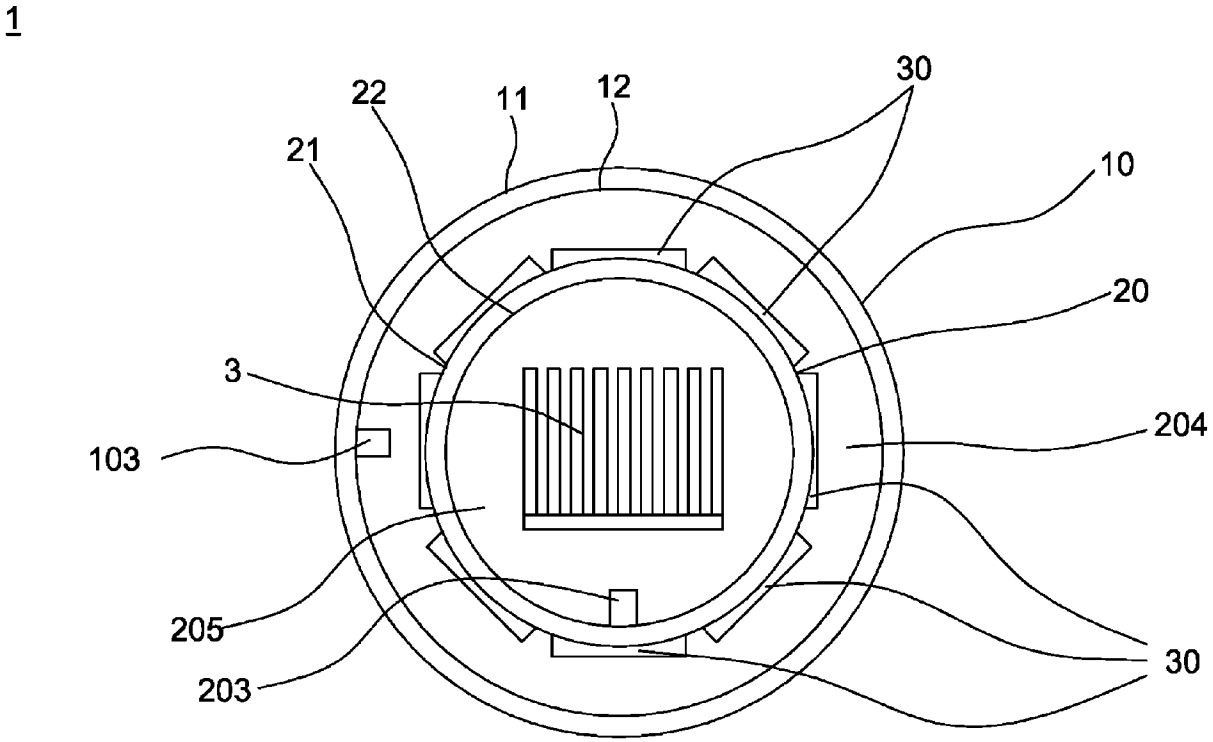
FIG. 3 is a schematic diagram representing the cross-sectional view of an embodiment of the heat treating furnace in the present invention.

Referring to FIG. 3 schematically represents the cross-sectional view of the embodiment of the heat treating furnace in the present invention. As shown in FIG. 3, the heating mechanism 30 is constituted of multiple heaters arranged next door to on the outer wall 21 of the inner body 20, wherein the heating mechanism 30 can be selected from a carbon heater or a halogen lamp heater, which heats the inner wall of the furnace to a set temperature. The carbon heater may provide electrical-resistance heating and the halogen lamp heater may provide infrared heating both of which heat the inner body 20 uniformly. In a preferred embodiment of the invention when the reaction gas is hydrogen selenide, the temperature reaches the range of 520° C. to 590° C. for performing the reaction. Referring to FIG. 3 again, illustrating the location of the gas circulation chamber 204, the reaction chamber 205 and a substrate 3; the substrate 3 was introduced longitudinally in coordination to the direction of gas flows inside, improve the uniformity of the reaction of thin film formation. Two holes are reserved for the passage of the gas pipes and the signal transmission circuit. Furthermore, for the reasons that the inner body 20 is operated under high pressure and temperature, and the reaction gas such as hydrogen selenide is corrosive, the inner wall 22 of the inner body 20 may be made of quartz or silicon dioxide ($SiO_2$) to prevent the inner body 20 from corrosion.

Figure 4:
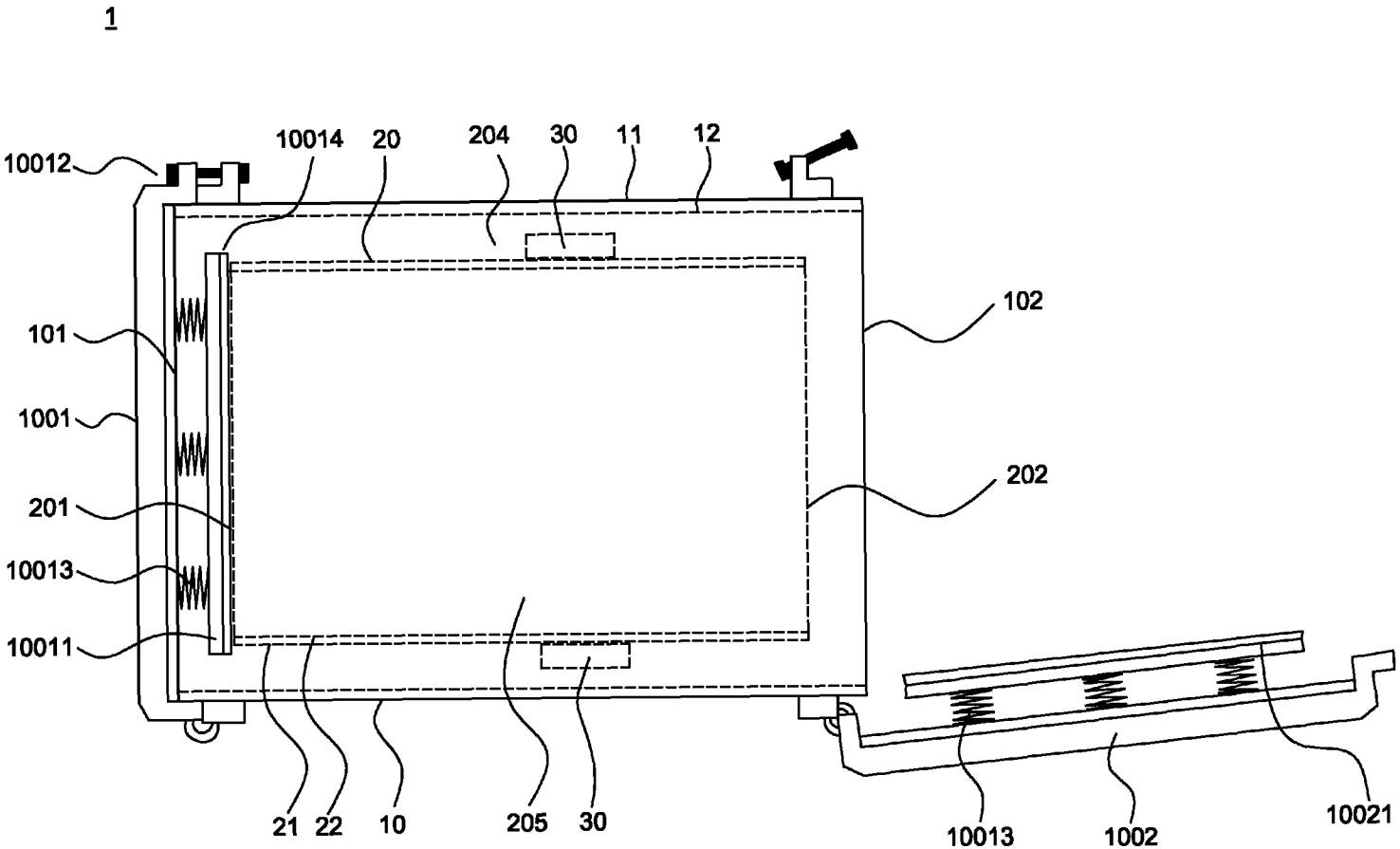
FIG. 4 is a schematic diagram representing the vertical view of the opened gate door in an embodiment of the heat treating furnace in the present invention.

Referring to FIG. 4 schematically representing the vertical view of the opened gate door of the heat treating furnace in the present invention, showing that, when the first gate door 1001 is closed, the first gas-tight structure 10011 is hermetically sealed with the third side 201 of the inner body 20. When the second gate door 1002 is closed, the second gas-tight structure 10021 is also hermetically sealed with the fourth side 202 of the inner body 20. Meanwhile, When the first gate door 1001 and the second gate door 1002 are closed, the damper 10013 and the gas seal 10014 are sealed and the gas seal 10014 is gas-tight by the elasticity of the damper 10013. After the first gate door 1001 and the second gate door 1002 being closed, a fastener 10012 can be used to fasten the first gate door 1001, the second gate door 1002, the first side 101 and the second side 102 of the outer body 10. It enables the gas circulation chamber 204 between the outer body 10 and the inner body 20, and the reaction chamber 205 between the inner wall 22 of the inner body 20 is an independent gas-tight chamber. Additionally, a silicon dioxide ($SiO_2$) layer or a corrosion-resistant coating can be formed separately on a side face of said first gas-tight structure contacted with said third side, and on a side face of said second gas-tight structure contacted with said fourth side, for preventing the gate doors from corrosion.

Referring to FIG. 4, showing that only one gate door (such as the first gate door 1001) is opened. Unless the heat treating furnace needs to be repaired, the other gate door (such as the second gate door 2001) is fastened and closed when the heat treating furnace of the present invention is normally operated.

It is further emphasized that the gas circulation chamber 204 and the reaction chamber 205 are separated and independent chambers without any communication of gases under the gas-tight environment. Apparently, the heat treating furnace of the present invention is different from that of the prior arts in that neither the gas pipes nor the signal transmission circuit is provided in the first gate doors 1001 of the heat treating furnace, thus the operation of inputting or outputting of materials causes no effect on the structural strength of the gas supplying mechanism 40 the heat treating furnace. In this way, not only the reliability of the heat treating furnace is improved but the operational safety concerns of leaking gas pipes are reduced; and the production of the heat treating furnace is even simplified.

Referring back to FIG. 2, the gas circulation chamber 204 is provided with at least one first sensor 103 and each of the first sensor 103 is connected with the controller 50. Meanwhile, the reaction chamber 205 is also provided with at least one second sensor 203 and each of the second sensor 203 is connected with the controller 50. When both the first sensor 103 and the second sensor 203 are pressure gauges, the pressure measured in the gas circulation chamber 204 ($P_1$) and the pressure measured in the reaction chamber 205 ($P_2$) are transmitted to the controller 50 and then the pressure difference ($P_1$-$P_2$) is calculated by the controller 50 and is accordingly controlled. It should be especially emphasized that the purpose of calculating the pressure difference ($P_1$-$P_2$) basing on the measurement of the first sensor 103 in the gas circulation chamber 204 and the second sensor 203 in the reaction chamber 205 of present invention is to control the pressure difference ($P_1$-$P_2$) precisely and practically; especially to control the outer pressure of the gas circulation chamber 204 slightly greater than the inner pressure of the reaction chamber 205. For example, in an embodiment of the present invention, the original pressure difference is set at 1 Kg/cm$^2$, and once the value of pressure difference is greater than 1 Kg/cm$^2$, the controller 50 immediately adjusts and increases the amount of gas input in the reaction chamber 205 and reduces the amount of gas input in the gas circulation chamber 204, thereby maintaining the pressure difference within a predetermined range. And in the preferred embodiment of the present invention, the outer pressure of the gas circulation chamber 204 is greater than 1 atm. With the safety consideration, obviously, the control of the pressure difference is executed by simultaneously controlling the gas input in both chambers (i.e. the gas circulation chamber and the circulation chamber).

Referring to FIG. 2 again, showing that a safety gate door 70 is further set between the gas circulation chamber 204 and the circulation chamber 205. For example, the safety gate door 70 is set between the outer wall 21 and inner wall 22 of the inner body 20, wherein the span of the outer wall 21 and inner wall 22 o is 6 to 25 mm. Once the pressure in the reaction chamber 205 ($P_2$) becomes greater than the set pressure in the gas circulation chamber 204 ($P_1$), the safety gate door 70 ruptures, allowing the gases in the gas circulation chamber 204 and the reaction chamber 205 to communicate. Because the pressure in the gas circulation chamber 204 ($P_1$) is slightly greater than the pressure in the reaction chamber 205 ($P_2$), the flowing hydrogen selenide in the gas circulation chamber 204 is directed to the reaction chamber 205 instead of leaking outside the furnace. Furthermore, the safety gate door 70 prevents the heat treating furnace 1 from being over pressured to damage the wall of quartz furnace. In the embodiment of the present invention, the working pressure in the reaction chamber 205 is generally maintained at 5 atm, far lower than the pressure resistance threshold of 20 atm. Thus, the heat treating furnace ensures the operational safety.

An embodiment is described here as an example to illustrate the safety design of the heat treating furnace of the present invention. Under an atmosphere pressure at 1 atm, when a pressure at 3 atm is measured by the first sensor 103 in the gas circulation chamber 204; a pressure at 2 atm is measured by the second sensor 203 in the reaction chamber 205. That is to say, the pressure in the gas circulation chamber 204 is greater than both the pressure in the reaction chamber 205 and atmosphere pressure. Under this circumstance and given the pressure difference provided by the heat treating furnace of the present invention, once the gas leaks, only the gas in the gas circulation chamber 204 such as nitrogen leaks outside, and at the same time, the reduction of the pressure in the gas circulation chamber 204 thereby causes the controller to reduce the pressure in the reaction chamber 205 to maintain the pressure difference. Therefore, there is no safety concern for the operators. For the improvement of safety, the heat treating furnace of the present invention can be operated under normal, low and high pressures, wherein the preferred range of working pressure is 0.5 to 9.8 atm.

However, if the operational pressure in the gas circulation chamber 204 and the operational pressure in the reaction chamber 205 are both less than 1 atm, for example, it is feasible to operate the heat treating furnace of the present invention when the pressure in the gas circulation chamber 204 is 1 atm and the pressure in the reaction chamber 205 is 0.98 atm.

In addition, when both the first sensor 103 and the second sensor 203 are pressure gauges, the reaction can be controlled by measuring the gas density. The way of controlling is based on the Boyle's law and the equation below: $P_aV_a/T_a=P_bV_b/T_b$ where $P_a$ is the pressure, $V_a$ is the volume and $T_a$ is the temperature at point a; $P_b$ is the pressure, $V_b$ is the volume and $T_b$ is the temperature at point b. The detail of the way of controlling will be described according to FIG. 6 and FIG. 7. When the first sensor 103 and the second sensor 203 are the combination of pressure gauge and gas density analyzer, users may control the reaction by controlling the pressure or controlling the density depending on the practical case itself, which is not limited in the present invention.

Accordingly, the gas supplying mechanism 40 is set outside the outer body 10, and is connected with one of the side of outer body 10 and one of the side of inner body 20 to provide and control the supply of at least one first gas (such as nitrogen $N_2$ and argon Ar) into the gas circulation chamber 204; and provide and control the supply of at least one second gas (such as hydrogen $H_2$, nitrogen $N_2$, hydrogen selenide $H_2Se$, hydrogen sulfide $H_2S$ and argon Ar) into the reaction chamber 205 for proceeding reaction. In addition the controller 50 in the present invention is provided outside the outer body 10 and connected with the gas supplying mechanism 40 by utilizing a plurality of gas pipes, for controlling the supply amount of the first gas into the gas circulation chamber 204 and the supply amount the second gas into the reaction chamber 205 through the gas supplying mechanism 40, thereby forming a first pressure ($P_1$) in the gas circulation chamber 204 and a second pressure ($P_2$) in the reaction chamber 205. It is emphasized that the controller 50 of the heat treating furnace of the present invention keeps the first pressure ($P_1$) in the gas circulation chamber 204 being greater than the second pressure ($P_2$) in the reaction chamber 205 all the time when the heat treating furnace is operated to perform a gas reaction. Or the controller 50 keeps the first density in the gas circulation chamber 204 being greater than the second density in the reaction chamber 205 all the time during the reaction. In an embodiment of the present invention, the first pressure ($P_1$) is kept within the range of 0.5 to 9.8 atm. Furthermore, other than controlling the amount of gas inflow, the controller 50 of the heat treating furnace of the present invention also monitors and controls the pressure, temperature, density, and toxicity, time, and gas types, etc. In other words, all the settings related to heat treating furnace are controlled and measured via the pressure sensor, density sensor, thermal sensor (not shown) and toxicity sensor (not shown), and the signals are transmitted by the signal transmission circuit to the controller 50 for further processing.

Figure 5:
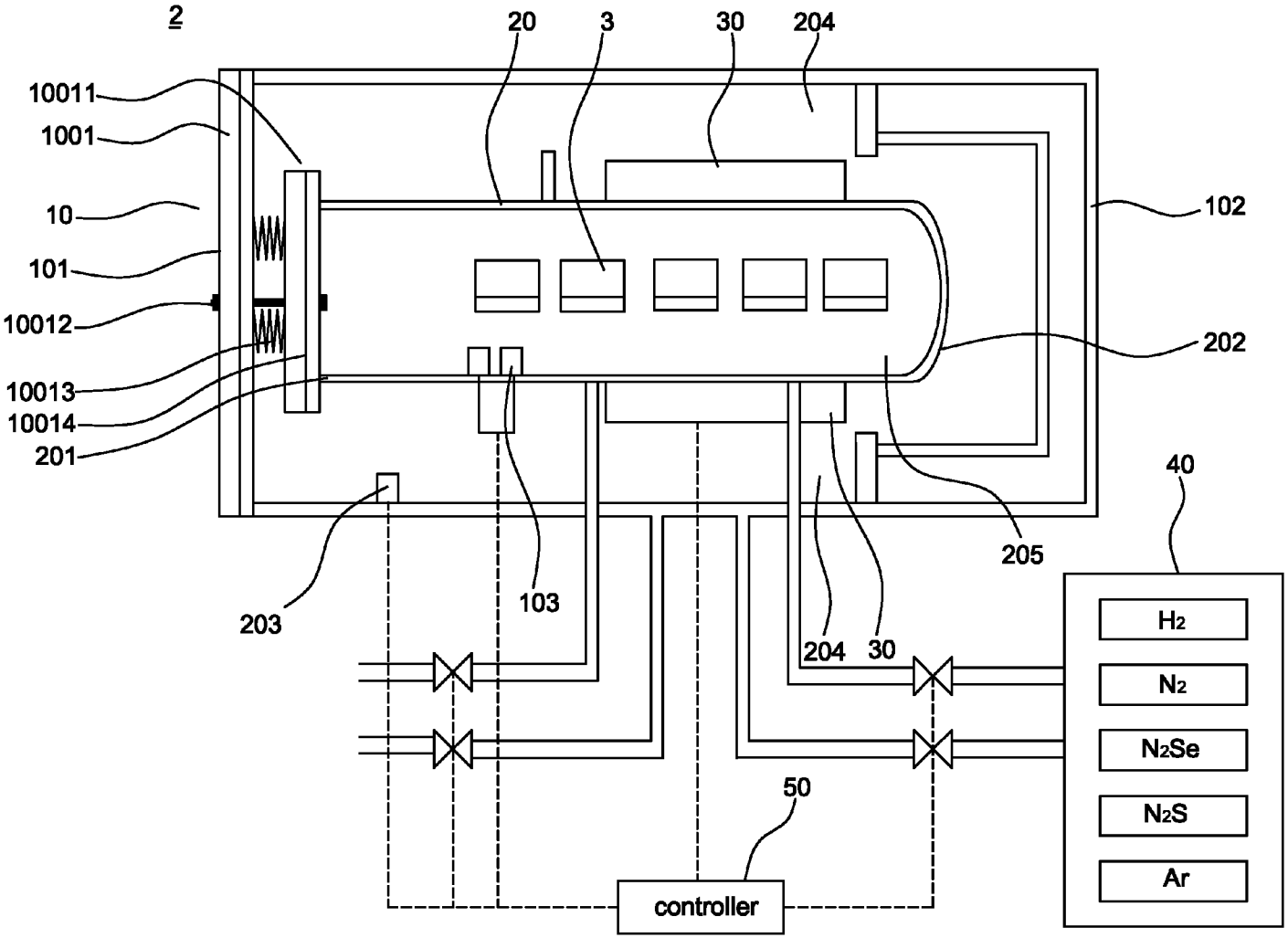
FIG. 5 is a schematic diagram representing another embodiment of the heat treating furnace in the present invention.

Referring to FIG. 5 schematically illustrating another embodiment of the heat treating furnace 2 of the present invention includes an outer body 10 having a outer wall 11 an a inner wall 12, and a first side 101, a second side 102 corresponding to the first side 101. The heat treating furnace 2 has an upper side face and a lower side face for connecting the first side 101 and the second side 102, thereby forming a receiving space. the first side 101 is provided with a first gate door 1001 capable of being opened, the second side 102 being a sealed side, a first gas-tight structure 10011 arranged inside the first gate door 1001. The heat treating furnace 2 has an inner body 20 spaced and fixed inside the outer body 10 having an outer wall 21, an inner wall 22, a third side 201 and a fourth side 202, and the fourth side 202 being connected with the sealed side thereby forming a gas circulation chamber 204 between the outer wall 21 and the outer body 10 and a reaction chamber 205 between the inner wall 22 of the inner body 20. When the first gate door 1001 is closed, the first gas-tight structure 10011 is hermetically sealed with the third side 201, thereby either of the gas circulation chamber 204 and the reaction chamber 205 being an independent gas-tight chamber. The heat treating furnace 2 has a heating mechanism 30 fixed and contacted with the outer wall 21 of the inner body 20. The heat treating furnace 2 has a gas supplying mechanism 40 set outside the outer body 10 being connected with the lower side face of outer body 10 and the outer will 21 of the inner body 20 by utilizing a plurality of gas pipes such as to supply at least one first gas (such as nitrogen $N_2$ and argon Ar) into the gas circulation chamber 204 and the supply of a second gas into the reaction chamber, and to supply at least one second gas (such as hydrogen $H_2$, nitrogen $N_2$, hydrogen selenide $H_2Se$, hydrogen sulfide $H_2S$ and argon Ar) into the reaction chamber 205. The heat treating furnace 2 has a controller is provided outside the outer body 10 and connected with gas pipes of the gas supplying mechanism 40, for controlling the supply amount of the first gas into the gas circulation chamber 204 and the supply amount the second gas into the reaction chamber 205 through the gas supplying mechanism, thereby forming a first pressure (P1) in the gas circulation chamber 204 and a second pressure (P2) in the reaction chamber 205.

Apparently, as shown in FIG. 5, except that only one first gate door 1001 is provided, other structural elements of the heat treating furnace 2 are the same with the heat treating furnace 1 of the embodiment described previously and shown in FIG. 2. The outer body 10 is made of steel or stainless steel such as SUS304 and SUS316. The inner body 20 is required for being operated under high temperature and pressure and susceptible to corrosion, hence it is made of quartz or silicon dioxide ($SiO_2$), wherein a side face of the first gas-tight structure 10011 is contacted with the third side 201 and a silicon dioxide ($SiO_2$) layer is coated on the side faces for preventing the first gate door 1001 from corrosion. In addition, at least one first sensor 103 is the gas circulation chamber 204 is provided with at least one first sensor 103 and each of the first sensor 103 is connected with the controller 50. Meanwhile, the reaction chamber 205 is also provided with at least one second sensor 203 and each of the second sensor 203 is connected with the controller 50. Likewise, if the gas density is used as a parameter for controlling, both the first sensor 103 and the second sensor 203 may be gas density analyzers in this embodiment. Besides, it is feasible to use the pressure gauges as the first sensor 103 and the gas density analyzer as the second sensor 203 to control the heat treating furnace 2, which depends on the practically used and can be switched by the users. Similarly, in this embodiment, the controller 50 may be chosen for controlling and keeping the pressure in the gas circulation chamber 204 ($P_1$) being greater than the pressure in the reaction chamber 205 ($P_2$) all the time all the time when the heat treating furnace 2 is operated to perform a gas reaction. Because the arrangement of the outer body 10 and the inner body 20 is the same in this embodiment and the embodiment shown in FIG. 2 (i.e. the heat treating furnace 1), the safety structures described previously are suitable for applying to the present embodiment, and is not necessary to be described in detail.

Apparently, one of the differences of the heat treating furnace of the present invention and the prior arts is in that neither the gas pipes nor the signal transmission circuit is provided in the first gate doors 1001 of the heat treating furnace, thus the operation of inputting or outputting of materials causes no effect on the structural strength of the gas supplying mechanism 40 the heat treating furnace. In this way, not only the reliability of the heat treating furnace is improved but the operational safety concerns of leaking gas pipes are reduced; and the production of the heat treating furnace is even simplified.

Figure 6:
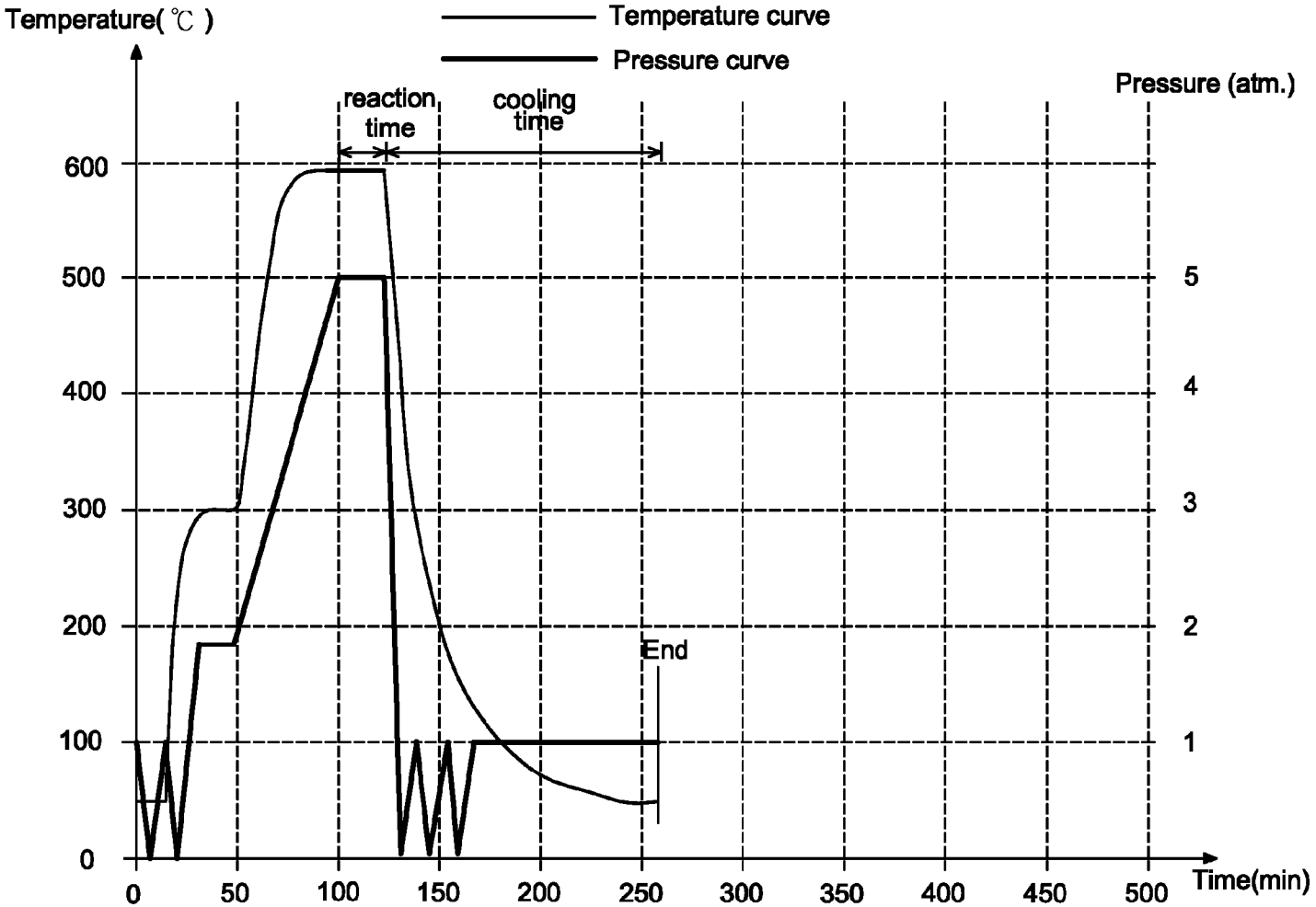
FIG. 6 is a schematic diagram representing the controlling profile of pressure and temperature of the heat treating furnace in the present invention.

Continue to refer FIG. 6, schematically representing the controlling profile of pressure and temperature of the heat treating furnace in the present invention. As shown in FIG. 6, after the first gate door 1001 and the second gate door 1002 being closed, the gas supplying mechanism 40 repeatedly pumps out the air and pumps in the gas such as gaseous nitrogen inside the gas circulation chamber 204 and the reaction chamber 205, to ensure that no residual mist or water vapor. Meanwhile, the heat treating furnace is heated into which the reaction gases are introduced. In this embodiment, hydrogen selenide (10%) and gaseous nitrogen (90%) which is the carrier gas are used for reaction. As shown in FIG. 6, during the heating process, after 50 minutes of reaction time, the temperature reaches a turning point (e.g. heating to 300° C.)., no more reaction gas is introduced and only the heating is continued. This operation is based on the Boyle's law and the equation below: $P_aV_a/T_a=P_bV_b/T_b$ where $P_a$ is the pressure, $V_a$ is the volume and $T_a$ is the temperature at point a; $P_b$ is the pressure, $V_b$ is the volume and $T_b$ is the temperature at point b. And the amount of reaction gas required in the reaction chamber 205 is determined prior to the operation, so that the introduction of the reaction gases is stopped one the amount of the reaction gases reaches to the setting value, and only the temperature is kept raising.

As the temperature being raised, the pressure in the reaction chamber is increased fast. For example, as the temperature reaches 590° C., the pressure in the reaction chamber 205 reaches around 5 atm, and then the reaction gases are reacting at 590° C. under 5 atm. Obviously, at this time the controller 50 keeps the pressure in the gas circulation chamber 204 at 5.1 atm. As shown in FIG. 6, only the reaction time of 20 minutes is required for completing the reaction. Immediately after the reaction, the fast cooling process is performed, meanwhile the controller 50 pumps out the residual non-reacting gas and then introduces the cooling gaseous nitrogen into the gas circulation chamber 204 and the reaction chamber 205 for cooling. The two walls of the inner body 20 in this embodiment of the present invention are cooled down simultaneously, which increases the cooling rate by two folds and reduces the concerns of chapping or peeling, thereby the input rate, amount of gas inflow, the cooling rate are accelerated to shorten the cooling time. Referring to FIG. 6 again, the heat treating furnace 1 needs only 120 minutes to reduce the temperature of 590° C. in the reaction chamber 205 to a range of 50 to 60° C., and allows to open the first gate door 1001 to take out the CIGS solar cell substrate 3 with selenized compound CIGS layers.

As the process described previously, measuring the pressure is a way of the present invention for controlling, the pressure in the gas circulation chamber 204 measured by the first sensor 103 and the pressure in the reaction chamber 205 measured by the second sensor 203 are transformed into signals and transmitted to the controller 50 and then the pressure difference ($P_1$-$P_2$) is controlled by the controller 50, which means the pressure in the gas circulation chamber 204 is kept being slightly greater than the pressure in the reaction chamber 205. Thus the reaction in the reaction chamber 205 is carried on smoothly. In this way, the heat treating furnace 1 of the present invention, no depressurization is needed for fast heating, and the selenization can be performed under high pressure, for example, the reaction time is 20 minutes in this embodiment. The other advantage of the present invention is the fast cooling process, only a cooling time of 120 minutes is needed for reducing the temperature to the range of 50 to 60° C. Apparently, according to FIG. 6, not only the selenization time but the cooling time is greatly reduced the heat treating furnace 1 of the present invention, therefore the usage rate of the heat treating furnace 1 is greatly raised to reduce the production cost.

Figure 7:
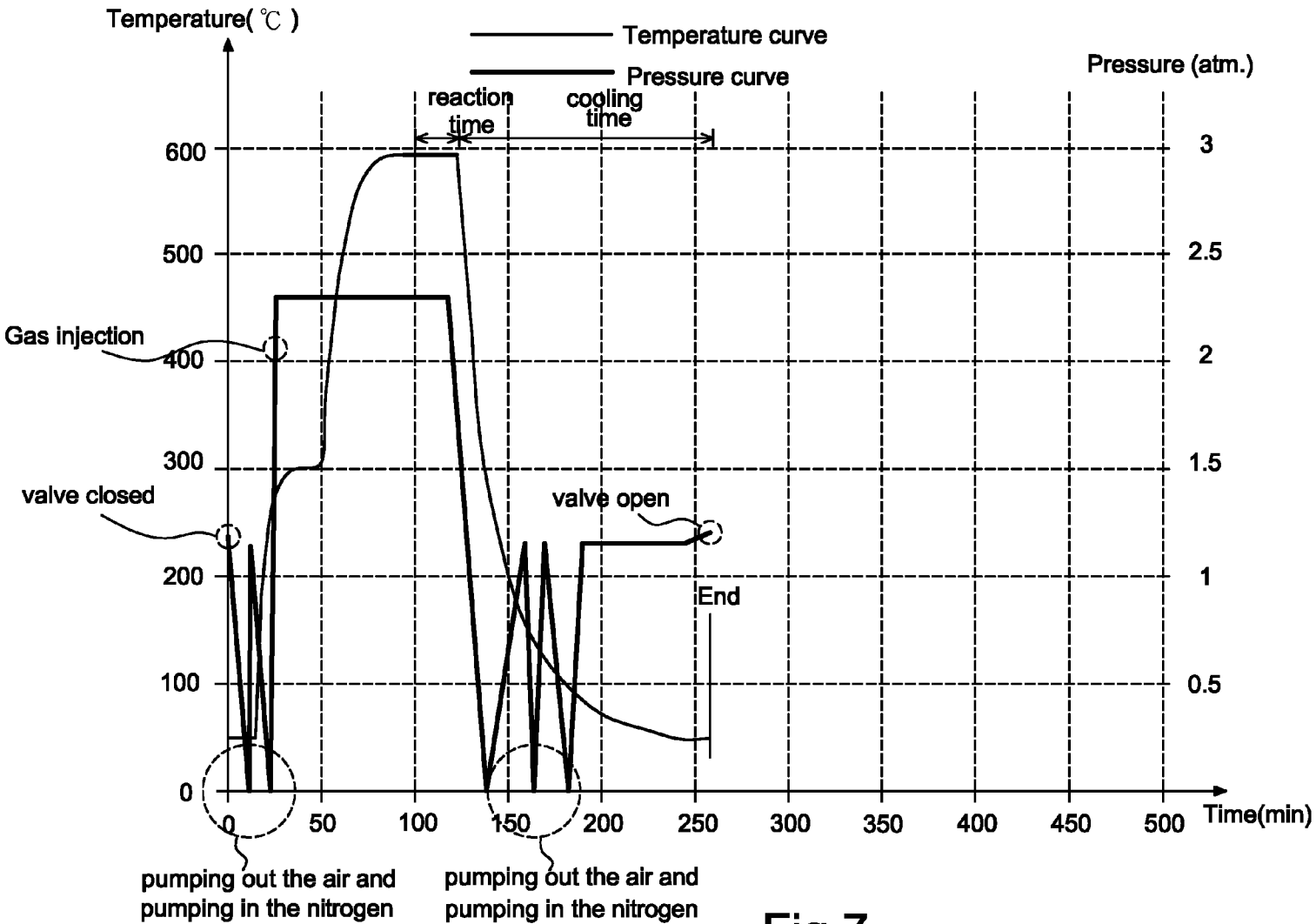
FIG. 7 is a schematic diagram representing the controlling profile of gas density and temperature of the heat treating furnace in the present invention.

Referring to FIG. 7 schematically representing the controlling profile of the gas density and temperature of the heat treating furnace in the present invention, the operation condition of the embodiment is described as following: the diameter of the inner body 20 is 1.1 m, depth is 2 m, the gas volume in the reaction chamber of the inner body 20 is 1235 L. The right Y axis in FIG. 7 represents the density, and after the first gate door 1001 being closed and nitrogen is introduced, the initial density is low due to the low density of nitrogen is lower than that of the air. A process of repeatedly pumping out the air and pumping in the nitrogen is completed to ensure no residual mist or water vapors inside, then the reaction gas, hydrogen selenide (10%) and gaseous nitrogen (90%, carrier gas) are introduced and following is the heating process. The controlling profile of pressure and temperature of the heat treating furnace is similar to those in FIG. 6, during the heating process, after 50 minutes of reaction time, the temperature reaches a turning point (e.g. heating to 300° C.), no more reaction gas is introduced into the reaction chamber 205. At the same time the amount of the reaction gas is constant in the reaction chamber 205. Corresponding to FIG. 6, the settings are shown as below: the temperature is at 590° C. and the pressure is at 5 atm. In this embodiment, the related gas densities in the heat treating furnace are: the mean gas density is 2.35 kg/m$^3$, the nitrogen density is 1.78 kg/m$^3$, and the hydrogen selenide density is 0.57 kg/m$^3$.

Referring FIG. 7 again, the reaction is performed under the mean gas density of 2.35 kg/m$^3$, the controller 50 keeps the pressure in the gas circulation chamber 204 greater than 2.35 kg/m$^3$ for the operation. Under the high gas density, the reaction rate is faster conventional heat treating furnace, as shown in FIG. 7, the selenization in the reaction chamber 205 takes around 20 minutes. Likewise, the cooling nitrogen is introduced into the reaction chamber 205 inside the inner body 20 and the gas circulation chamber 204 outside the outer wall, and there is no concern of the temperature gradient occurring in the wall of the inner body 20, which amplified the amount of gas inflow. Within less than 2 hours, the cooling process is completed. Once the gate door is opened, the temperature will be 25° C. due to the air inflow in the reaction chamber 205, and the general air density is 1.184 kg/m$^3$.

Due to that measuring the gas density is a way of the present invention for controlling, the gas density in the gas circulation chamber 204 measured by the first sensor 103 and the gas density in the reaction chamber 205 measured by the second sensor 203 are transformed into signals and transmitted via the signal transmission circuit to the controller 50 and then the gas density difference is controlled by the controller 50, which means the gas density in the gas circulation chamber 204 is kept being slightly greater than the gas density in the reaction chamber 205. Thus the reaction in the reaction chamber 205 is carried on smoothly. In this way, the heat treating furnace 1 of the present invention, no depressurization is needed for fast heating, and the selenization can be performed under high gas density (e.g. 2.35 kg/m$^3$), accelerating the reaction. For example, the reaction time is 20 minutes in this embodiment. The other advantage of the present invention is the fast cooling process, only a cooling time of 120 minutes is needed for reducing the temperature to the range of 50 to 60° C. Apparently, according to FIG. 6, not only the selenization time but the cooling time is greatly reduced the heat treating furnace 1 of the present invention, therefore the usage rate of the heat treating furnace 1 is greatly raised to reduce the production cost.

Similarly, the first sensor 103 of the gas circulation chamber 204 can be a pressure gauge and the second sensor 203 of the reaction chamber 205 can be a gas density analyzer illustrated in FIG. 2 and FIG. 5, and the signals measured by the pressure gauge or gas density analyzer can be transmitted to the controller 50 by the signal transmission circuit, to control and adjust the amount of gas inflows in the gas circulation chamber 204 and the reaction chamber 205. Therefore the heat treating furnace of the present invention can be controlled according to the pressure or the density depending on the practical case.

All the above descriptions are based on the example of CIGS thin film solar cell substrate 3. However, the heat treating furnace of the present invention can also be applied in other kinds of fabrication. Taking the Copper Zinc Tin Sulfide (CZTS) thin film solar cell for another example, The hydrogen selenide gas is also used for the reaction with copper, zinc and tin in the heat treating furnace of the present invention to produce the CZTS thin film solar cells.

Figure 8:
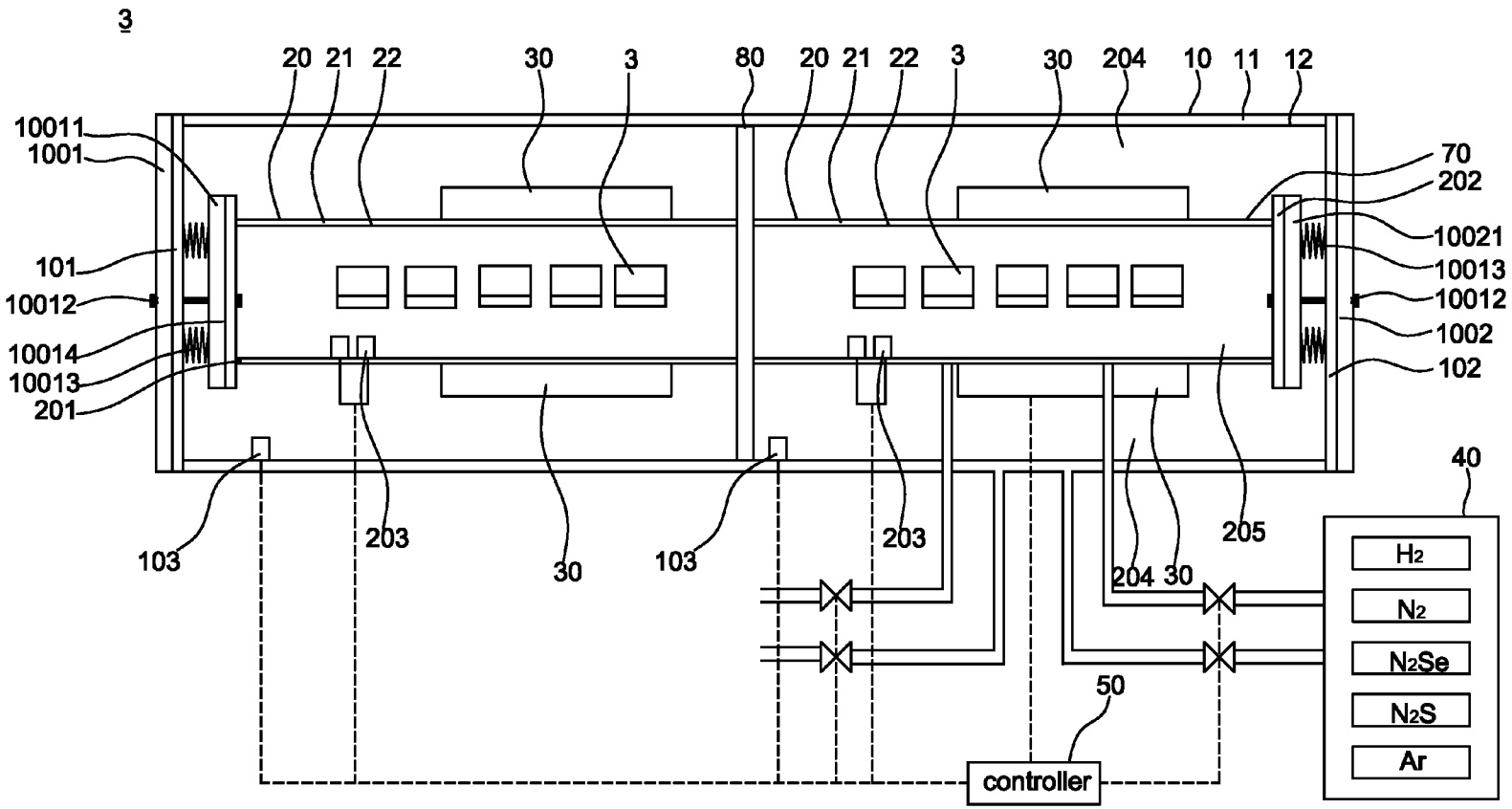
FIG. 8 is a schematic diagram representing the multi-stage heat treating furnace according to an embodiment of the invention.

Referring to FIG. 8 schematically representing the embodiment of the multi-stage heat treating furnace jointed by multiple heat treating furnaces in the present invention, the multi-stage heat treating furnace 3 is horizontally arranged, hence the multi-stage heat treating furnace 3 has two holes in the ends. In other words, the outer body 10 has a first side 101 and a second side 102 corresponding to the first side 101. When the two heat treating furnace 1 are jointed, meaning that the first side 101 of the first outer boy 10 and the second side 102 of the second outer body 10 are jointed, by the gas seal device 80 such as a air tight ring. Thus the first 101 and the second side of the two heat treating furnace hermetically sealed. And then the third side 201 of one inner body 20 in one heat treating furnace is connected with the fourth side 202 of the other inner body 20 to form the multi-stage heat treating furnace 3. It is emphasized that, the structure of each the heat treating furnace in the multi-stage heat treating furnace 3 is the same with the heat treating furnace 1 shown in FIG. 2, thus the structure needs not to be described in detail.

After jointing the two heat treating furnaces for forming the multi-stage heat treating furnace 3, a first vale 1001 and a second gate door 1002 capable of being opened are further provided respectively in each of the two end of the multi-stage heat treating furnace 3. When the first vale 1001 is opened and the second gate door 1002 is closed, the first side 101 and the second side 102 of the heat treating furnace are sealed by a first gas-tight structure 10011 and a second gas-tight structure 10021. Meanwhile, the first gas-tight structure 10011 is hermetically sealed with the third side 201 by the gas seal 10014 forming a gas circulation chamber 204 between the inner wall 12 of the outer body 10, which means that the gas circulation chamber 204 is formed by the joint of the gas circulation chamber in the two heat treating furnace. The second gas-tight structure 10021 is also hermetically sealed with the fourth side 202 of the inner body 20 via the gas seal 10014, forming a reaction chamber 205, which means the reaction chamber 205 is formed by the joint of the reaction chamber in the two heat treating furnace. Therefore, either of the gas circulation chamber 204 and the reaction chamber 205 is an independent gas-tight chamber without any communication.

Moreover, the thermal insulating material can be further provided on the inner wall 12 of the outer body 10 of the multi-stage heat treating furnace 3 to disrupt the transmission of heat to the outer wall 11 of the outer body 10 during the heating process. And the thermal insulating material can be any heat-resistant material such as quartz bricks or mica brick.

Additionally, the multi-stage heat treating furnace 3 includes a heating mechanism 30 being fixed and contacted with the outer 21 wall of the inner body 20. At the same time, the multi-stage heat treating furnace 3 includes a gas supplying mechanism 40 set outside the outer body 10 being connected with one of the side of outer body 10 and one of the side of inner body 20 by utilizing a plurality of gas pipes such as to control the supply of gases into the gas circulation chamber 204 and the reaction chamber 205. The multi-stage heat treating furnace 3 includes a controller 50, which is provided outside the outer body 10 for precisely controlling the supply amount of gases into the gas circulation chamber 204 and the reaction chamber 205 through the gas supplying mechanism 40, thereby forming a first pressure ($P_1$) in the gas circulation chamber 204 and a second pressure ($P_2$) in the reaction chamber 205, or thereby forming the feature that a first density in the gas circulation chamber 204 and a second density in the reaction chamber 205. Similarly, the controller 50 of multi-stage heat treating furnace of the present invention keeps the first pressure ($P_1$) in the gas circulation chamber 204 being greater than the second pressure ($P_2$) in the reaction chamber 205; or keeps the first density in the gas circulation chamber 204 being greater than the second density in the reaction chamber 205, all the time when the heat treating furnace is operated to perform the selenization reaction. The arrangement of the outer body 10 and the inner body 20 in the multi-stage heat treating furnace of this embodiment is the same with the heat treating furnace 1 shown in FIG. 2, thus the safety structures described previously are suitable for applying to the present embodiment. For example, at least one safety gate door 70 is further set between the gas circulation chamber 204 and the circulation chamber 205, so that it needs not to be described in detail.

Apparently, one of the differences of the heat treating furnace of the present invention and the prior arts is in that neither the gas pipes nor the signal transmission circuit is provided in the first gate doors 1001 of the heat treating furnace, thus the operation of inputting or outputting of materials causes no effect on the structural strength of the gas supplying mechanism 40 the heat treating furnace. In this way, not only the reliability of the heat treating furnace is improved but the operational safety concerns of leaking gas pipes are reduced; and the production of the heat treating furnace is even simplified. Furthermore, the multi-stage heat treating furnace 3 jointed by multiple heat treating furnaces can effectively not only saves the facility cost but raises the production profit.

The present invention is disclosed above by preferred embodiments. However, persons skilled in the art should understand that the preferred embodiments are illustrative of the present invention only, but should not be interpreted as restrictive of the scope of the present invention. Persons skilled in the art are able to understand and implement the above disclosure of the present invention. Hence, all equivalent changes or modifications made to the aforesaid embodiments without departing from the spirit embodied in the present invention should fall within the scope of the present invention.

What is claimed is:

1. A heat treating furnace for a gas reaction comprising:

an outer body having a first side and a second side corresponding to said first side, said first side being provided with a first gate door capable of being opened, said second side being provided with a second gate door capable of being opened, a first gas-tight structure arranged inside said first gate door, a second gas-tight structure arranged inside said second gate door;

an inner body having an outer wall and an inner wall, being spaced and fixed inside said outer body, thereby forming a gas circulation chamber between said outer wall and said outer body and a reaction chamber between said inner wall, said inner body having a third side and a fourth side corresponding to said third side, and when said first gate door is being closed, said first gas-tight structure being hermetically sealed with said third side and said second gas-tight structure being hermetically sealed with said fourth side, thereby either of said gas circulation chamber and said reaction chamber being an independent gas-tight chamber;

a heating mechanism being fixed and contacted with said outer wall of said inner body; and a gas supplying mechanism set outside said outer body being connected with one of said side of outer body and one of said side of inner body by utilizing a plurality of gas pipes such as to control the supply of a first gas into said gas circulation chamber and the supply of a second gas into said reaction chamber; and a controller provided outside said outer body for controlling the supply amount of said first gas into said gas circulation chamber and the supply amount said second gas into said reaction chamber through said gas supplying mechanism, thereby forming a first pressure ($P_1$) in said gas circulation chamber and a second pressure ($P_2$) in said reaction chamber.

2. The heat treating furnace of claim 1, wherein said outer body is made of steel or stainless steel.

3. The heat treating furnace of claim 1, wherein said inner body is made of quartz or silicon dioxide ($SiO_2$).

4. The heat treating furnace of claim 1, wherein a side face of said first gas-tight structure is contacted with said third side, and a side face of said second gas-tight structure is contacted with said fourth side, a silicon dioxide ($SiO_2$) layer or a corrosion-resistant coating being formed separately on said side faces for preventing corrosion.

5. The heat treating furnace of claim 1, wherein said gas circulation chamber is provided with at least one first sensor and each of said first sensor is connected with said controller.

6. The heat treating furnace of claim 1, wherein said reaction chamber is provided with at least one second sensor and each of said second sensor is connected with said controller.

7. The heat treating furnace of claim 5, wherein said first sensor is a pressure gauge or a gas density analyzer.

8. The heat treating furnace of claim 6, wherein said second sensor is a pressure gauge or a gas density analyzer.

9. The heat treating furnace of claim 1, wherein said heating mechanism is a carbon heater or a halogen lamp heater.

10. The heat treating furnace of claim 1, wherein said first pressure (P1) is greater than 1 atm.

11. A heat treating furnace for a gas reaction comprising:

an outer body having a first side and a second side corresponding to said first side, said first side being provided with a first gate door capable of being opened, said second side being provided with a second gate door capable of being opened;

an inner body having an outer wall and an inner wall, being spaced and fixed inside said outer body, thereby forming a gas circulation chamber between said outer wall and said outer body and a reaction chamber, and when said first gate door and said second gate door are being closed, thereby either of said gas circulation chamber and said reaction chamber being an independent gas-tight chamber;

a heating mechanism being fixed and contacted with said outer wall of said inner body;

a gas supplying mechanism set outside said outer body being connected with one of said side of outer body and one of said side of inner body by utilizing a plurality of gas pipes such as to control the supply of a first gas into said gas circulation chamber and the supply of a second gas into said reaction chamber; and a controller for controlling the supply amount of said first gas into said gas circulation chamber and the supply amount said second gas into said reaction chamber through said gas supplying mechanism, thereby forming a first pressure ($P_1$) in said gas circulation chamber and a second pressure ($P_2$) in said reaction chamber.

12. The heat treating furnace of claim 11, wherein said outer body is made of steel or stainless steel.

13. The heat treating furnace of claim 11, wherein said inner body is made of quartz or silicon dioxide ($SiO_2$).

14. The heat treating furnace of claim 11, wherein a side face of said first gas-tight structure is contacted with said third side, a silicon dioxide ($SiO_2$) layer or a corrosion-resistant coating being formed on said side face.

15. The heat treating furnace of claim 11, wherein said gas circulation chamber is provided with at least one first sensor and each of said first sensor is connected with said controller.

16. The heat treating furnace of claim 11, wherein said reaction chamber is provided with at least one second sensor and each of said second sensor is connected with said controller.

17. The heat treating furnace of claim 15, wherein said first sensor is a pressure gauge or a gas density analyzer.

18. The heat treating furnace of claim 16, wherein said second sensor is a pressure gauge or a gas density analyzer.

19. The heat treating furnace of claim 11, wherein said controller keeps said first pressure ($P_1$) in said gas circulation chamber being greater than said second pressure ($P_2$) in said reaction chamber all the time when said heat treating furnace is operated to perform a gas reaction.

20. The heat treating furnace of claim 11, wherein said heating mechanism is a carbon heater or a halogen lamp heater.

21. A multi-stage heat treating furnace for a gas reaction constituted by a plurality of heat treating furnaces wherein each of said heat treating furnace comprising:

an outer body having a first side and a second side corresponding to said first side, said first side being provided with a first gate door capable of being opened, said second side being provided with a second gate door capable of being opened, a first gas-tight structure arranged inside said first gate door, a second gas-tight structure arranged inside said second gate door;

an inner body having an outer wall and an inner wall, being spaced and fixed inside said outer body, thereby forming a gas circulation chamber between said outer wall and said outer body and a reaction chamber between said inner wall, said inner body having a third side and a fourth side corresponding to said third side, and when said first gate door is being closed, said first gas-tight structure being hermetically sealed with said third side and said second gas-tight structure being hermetically sealed with said fourth side, thereby either of said gas circulation chamber and said reaction chamber being an independent gas-tight chamber;

a heating mechanism being fixed and contacted with said outer wall of said inner body;

a gas supplying mechanism set outside said outer body being connected with one of said side of outer body and one of said side of inner body by utilizing a plurality of gas pipes such as to control the supply of a first gas into said gas circulation chamber and the supply of a second gas into said reaction chamber; and a controller provided outside said outer body for controlling the supply amount of said first gas into said gas circulation chamber and the supply amount said second gas into said reaction chamber through said gas supplying mechanism, thereby forming a first pressure ($P_1$) in said gas circulation chamber and a second pressure ($P_2$) in said reaction chamber.

22. The multi-stage heat treating furnace of claim 21, wherein said outer body is made of steel or stainless steel.

23. The multi-stage heat treating furnace of claim 21, wherein said inner body is made of quartz or silicon dioxide ($SiO_2$).

24. The multi-stage heat treating furnace of claim 21, wherein a side face of said first gas-tight structure is contacted with said third side, a silicon dioxide ($SiO_2$) layer or a corrosion-resistant coating being formed on said side face.

25. The multi-stage heat treating furnace of claim 21, wherein said gas circulation chamber is provided with at least one first sensor and each of said first sensor is connected with said controller.

26. The multi-stage heat treating furnace of claim 21, wherein said reaction chamber is provided with at least one second sensor and each of said second sensor is connected with said controller.

27. The multi-stage heat treating furnace of claim 21, wherein said controller keeps said first pressure ($P_1$) in said gas circulation chamber being greater than said second pressure ($P_2$) in said reaction chamber all the time when said heat treating furnace is operated to perform a gas reaction.

28. The multi-stage heat treating furnace of claim 21, wherein said heating mechanism is a carbon heater or a halogen lamp heater.

29. A heat treating furnace for a gas reaction comprising:

an outer body having a first side and a second side corresponding to said first side, an upper side face and a lower side face for connecting said first side and said second side, thereby forming a receiving space, said first side being provided with a first gate door capable of being opened, said second side being a sealed side, a first gas-tight structure arranged inside said first gate door; an inner body spaced and fixed inside said outer body having an outer wall, an inner wall, a third side and a fourth side, and said fourth side being connected with said sealed side thereby forming a gas circulation chamber between said outer wall and said outer body and a reaction chamber between said inner wall, and when said first gate door is being closed, said first gas-tight structure being hermetically sealed with said third side, thereby either of said gas circulation chamber and said reaction chamber being an independent gas-tight chamber;

a heating mechanism being fixed and contacted with said outer wall of said inner body;

a gas supplying mechanism set outside said outer body being connected with one of said side of outer body and one of said side of inner body by utilizing a plurality of gas pipes such as to control the supply of a first gas into said gas circulation chamber and the supply of a second gas into said reaction chamber; and a controller provided outside said outer body for controlling the supply amount of said first gas into said gas circulation chamber and the supply amount said second gas into said reaction chamber through said gas supplying mechanism, thereby forming a first pressure ($P_1$) in said gas circulation chamber and a second pressure ($P_2$) in said reaction chamber.

30. The heat treating furnace of claim 29, wherein said controller keeps said first pressure ($P_1$) in said gas circulation chamber being greater than said second pressure ($P_2$) in said reaction chamber all the time when said heat treating furnace is operated to perform a gas reaction.

* * * * *